US009167675B2

(12) United States Patent
Ortiz-Gavin et al.

(10) Patent No.: US 9,167,675 B2
(45) Date of Patent: Oct. 20, 2015

(54) HIGH FREQUENCY PROGRAMMABLE PULSE GENERATOR LIGHTING APPARATUS, SYSTEMS AND METHODS

(71) Applicants: Sergio Alejandro Ortiz-Gavin, Los Angeles, CA (US); Peter Papp, Szekesfehervar (HU); Laszlo Kozma, Budapest (HU)

(72) Inventors: Sergio Alejandro Ortiz-Gavin, Los Angeles, CA (US); Peter Papp, Szekesfehervar (HU); Laszlo Kozma, Budapest (HU)

( * ) Notice: Subject to any disclaimer, the term of this patent is extended or adjusted under 35 U.S.C. 154(b) by 0 days.

(21) Appl. No.: 13/925,758

(22) Filed: Jun. 24, 2013

(65) Prior Publication Data

US 2014/0152193 A1 Jun. 5, 2014

Related U.S. Application Data

(60) Provisional application No. 61/663,498, filed on Jun. 22, 2012.

(51) Int. Cl.

| | |
|---|---|
| ***H05B 37/02*** | (2006.01) |
| ***H05B 41/30*** | (2006.01) |
| *H05B 41/288* | (2006.01) |
| *H05B 41/292* | (2006.01) |

(52) U.S. Cl.
CPC ..... *H05B 41/30* (2013.01); *H05B 41/288* (2013.01); *H05B 41/2928* (2013.01)

(58) Field of Classification Search
USPC ..... 315/83, 117–120, 127, 209 R, 224, 225, 315/287, 291, 294, 307, 360
See application file for complete search history.

(56) References Cited

U.S. PATENT DOCUMENTS

| | | | | |
|---|---|---|---|---|
| 5,010,278 | A * | 4/1991 | Kang | 315/224 |
| 7,880,399 | B2 * | 2/2011 | Sieβegger | 315/244 |
| 2002/0079848 | A1 * | 6/2002 | Wicklund et al. | 315/291 |
| 2009/0138972 | A1 * | 5/2009 | Scales | 726/24 |
| 2009/0302777 | A1 * | 12/2009 | Li et al. | 315/287 |
| 2010/0097011 | A1 * | 4/2010 | Wilken | 315/326 |

* cited by examiner

*Primary Examiner* — Tung X Le
(74) *Attorney, Agent, or Firm* — Edward C. Schewe

(57) ABSTRACT

A high frequency pulse generator, a distributed parameter coupling line, a sequential pulse variable voltage ignition system using a standard HMI lamp or a specialized ultra high frequency HMI lamp to provide a high Color Rendering Index, to reduce or eliminate audit lamp and igniter resonance and provide for a wide range of color correction from 7000° Kelvin to 3000° Kelvin from a standard HMI lamp.

14 Claims, 7 Drawing Sheets

HIGH FREQUENCY PROGRAMMABLE PULSE GENERATOR LIGHTING APPARATUS, SYSTEMS AND METHODS

RELATED APPLICATION DATA

This application claims the benefit of U.S. Provisional Patent Application Ser. No. 61/663,498, titled High Frequency Programmable Pulse Generator Lighting Apparatus, Systems and Methods filed on Jun. 22, 2012.

BACKGROUND OF THE INVENTION

1. Field of the Invention

This present invention is directed to high frequency pulse generators, or ballasts as known to skilled persons, a distributed parameter coupling line, or head cable as known to skilled persons, a sequential pulse variable voltage ignition system using a standard HMI lamp or a specialized ultra high frequency HMI lamp. The invention provides a high CRI (Color Rendering index), reduces or eliminates audible lamp and igniter resonance and provides for a wide range of color correction from 7000° Kelvin to 3000° Kelvin from a standard HMI lamp.

2. Description of the Related Art

New advances in professional digital cinema require new tools and solutions for an increasingly difficult and complicated problem, lighting. These problems are well known by directors of photography, gaffers, electricians and knowledgeable professionals.

SUMMARY OF THE INVENTION

The wandering are and flickering inherent in HMI medium are gas discharge lamps used in conjunction with higher and higher frame rates amplify this problem. By manipulating frequency and wave forms in the megahertz range, current, voltage and energy, we find the sweet spot in each wattage lamp and greatly reduce or eliminate this problem at frame rates or up to 500,000 fps.

Color Temperature. Manufacturers of HMI lamps used in stage, studio, location, motion picture, video and photography produce lamps that are rated between 6000 K and 6200 K. In order to get the correct color temperature, HMI lighting manufacturers add filters to the lights to warm them up to a desired color temperature. Directors of photography might require a broad range of color temperatures. Depending on the shot, the gelling or filtering of lights is complicated, time consuming and expensive.

By carefully manipulating frequency and wave form in the megahertz range, current, voltage and energy, we can color correct without the use of filters of any kind. In embodiments of the invention, a very wide range of color temperatures, from 7000 K up to 4500 K, are available, all using a standard HMI lamp.

Color Temperature shifting to an undesirable color temperature while dimming. By carefully manipulating frequency and wave form in the megahertz range, current, voltage and energy, we can reduce this problem without the use of filters of any kind.

The harmonic resonance inherent in the HMI lamp and igniter. This classic buzzing "HMI Noise" is a constant problem during filming. Sound engineers are skilled in ways to filter out HMI noise but when filming involves lighting close to actors in a scene involving dialog, they are sometimes unable to cancel out the offending sound and must correct during post-production or record sound and dialog at a later date. By carefully manipulating frequency and wave form in the megahertz range, current, voltage and energy, we can reduce or eliminate this problem.

Ultra High Frequency. Conventional manufacturers of stage, studio, location, motion picture, video, and photography HMI lighting have recently added high frequency ballasts to their product range that go as high as 1000 Hz, the present invention goes way beyond into the MHz range.

Typically, conventional manufacturers offer ballasts with one or two power options, each one must have its own dedicated head and igniter. The present invention offers a virtually unlimited range of power options. The fully programmable system can be accessed from the display, users can program in any gas discharge lamp within range (sodium vapor, HMI, Metal Halide, CMH, Short Arc Xenon, Long arc. Xenon, etc.). For example, in one embodiment, the 2.5K range pulse generators come preprogrammed for eight lamps from 575 W to 2.5K in just HMI lamps alone. This is all done with one connector, one igniter and head.

Power Plus Mode. In embodiments, a user can safely greatly over power the lamp for short periods of time to gain increased luminous output.

Variable Voltage Sequential Pulse Ignition. The ignition and hot re-striking of gas discharge lamps is increasingly difficult depending on the wattage of the lamps and lamp temperature. Conventional HMI ballasts and head ignite lamps with one static unchanging high voltage AC spike, usually the highest possible voltage that won't short circuit the lamp which damages the lamp and reduces lamp life.

In embodiments of the invention, we have a regulated ignition that layers variable AC and variable DC voltage in sequential variable pulses igniting the lamp at the lowest possible voltage. Then, a sensing ignition terminates the ignition sequence and bypasses the ignition coils eliminating harmonic resonance, reducing damage to the lamp, extending the life of the lamp and aids in eliminating the classic HMI buzzing of the lamp (silent lamp technology).

Starting the lamp with a complex waveform for optimum lifetime-expansion of the bulb and minimum time to reach the desired operational color temperature. A pre-programmed complex waveform is provided by the generator for the bulb during the ignition and heat-up processes.

The shape of voltage and current waveforms are carefully matched to the actual bulb. Therefore each different type of bulb receives the best operational parameters during the ignition and warming-up processes. The exciting waveforms are created together by a programmed device (a well known microprocessor with memory function and inputs) and high frequency switching devices followed by passive waveform-shaping networks.

The generator unit has the ability to change the parameters of current and voltage shaping networks by auxiliary switching devices. Variable network parameters are required to ensure the optimal shape of waveforms transmitted to the bulb. The variable passive wave-shaping network has the impedance matching function of the generator to the bulb has been implemented together with active load-cable compensation.

During operation, the average power level of the bulb as well as the average light output can be manipulated by changing various parameters of high frequency switching devices like switching frequency, pulse width together with the variable parameters of waveform shaping passive, networks. The operational parameters of the bulb are continuously monitored in real-time by a preprogrammed device which runs application specific software and provides high-frequency driving for the power switching devices and adjusts the parameters of waveform shaping network to keep all parameters of the bulb in the desired operation.

In one embodiment, each different bulb has its exclusively programmed values of exciting currents and voltages across the different operational conditions. This method has the advantage that either the actual power level and/or amount of output light can be adjusted precisely and is repeatable as well as the color temperature while the bulb is still flicker-free and the arc is stable. When all of the electrical parameters of the bulb have to be set "stable" the amount of output light is free of change of electrical environmental conditions like AC line voltage or AC line frequency.

The generator unit has feedback from the lamp parameters and the amount of output light can be changed by precisely varying the exciting current and voltage waveforms. The output light could be less or more than the nominal values of the actual bulb while the light is free of flicker and instability. Are instability would have an effect on the light output in the shorter time domain what would affect the higher frame-rate photography applications. It gives a possibility of precisely repeatable dimming so the amount of output light can be set by high accuracy without the problem of the arc becomes unstable and flickering would create problems on higher frame-rates (filming).

The various dimming values are preprogrammed in the main controller microprocessor unit and the electrical parameters of the bulb like current and voltage waveforms are carefully adjusted in real-time. The controller provides pulse frequency and pulse width modulation for the main switching devices while simultaneously sets the values of passive waveform shaping network by auxiliary switching devices.

The color temperature of the bulb can be regulated or set to the desired value by carefully manipulating the exciting current and voltage waveforms. The setting depends on the actual bulb there are several hundred or few thousands of Kelvin adjustments range without arc instability or flickering problems. During the color temperature regulation the generator provides programmed high-frequency waveforms for the power switching devices while adjust the parameters of passive waveform shaping networks by auxiliary switches. With the high-frequency complex waveform operation not only the color temperature and average light output but the CRI parameters of the bulb can be maintained very precisely.

When the bulb is driven by complex waveform generator all of the sub and upper harmonics of driver current and voltage waveforms are far out from the audible sound range therefore the bulb is virtually perfectly silent. In embodiments, it is important that the driver waveform has no close numbered harmonics like f/2, f/4 which would be close to the characteristic resonant frequencies of the actual bulb.

Due to the very high frequency operation and the typical harmonics content of the complex pre-programmed waveforms most of the possible problematic harmonics are located far above the bulb's acoustics resonant frequencies. This way the are is always stable and free of flickering and acoustics instabilities in the whole operational range. It is important because the acoustics resonances would not only create flicker and output light vibrations/instabilities but could easily affect the color temperature and CRI index too.

Depending on voltage, in 80→270, the ballast makes adjustments to the lamp (voltage, current, waveform, frequency, current angle, etc.) to maintain optimum color temperature and optimum frequency for the most stable arc possible eliminating wandering arc. In embodiments that dim the lamp, we manipulate a wide variety of parameters (voltage, current, waveform, frequency, current angle, etc.) to maintain optimum color temperature and optimum frequency for the most stable arc possible eliminating wandering arc.

BRIEF DESCRIPTION OF THE DRAWINGS

FIG. 2 illustrates a schematic diagram showing an embodiment of the invention.

FIG. 5A through FIG. 5E1 illustrate embodiments of the invention showing high frequency lamps.

FIG. 6A through FIG. 6E1 illustrate further embodiments of the invention showing high frequency lamps.

DETAILED DESCRIPTION OF EMBODIMENTS OF THE INVENTION

Reference is made to the Figures in which elements of the illustrated embodiments of the invention are given numerical designations so as to enable one skilled in the art to make and use the invention. It is understood that the following description is exemplary of embodiments of the invention and it is apparent to skilled persons that modifications are possible without departing from the inventive concepts herein described.

Figure 1:
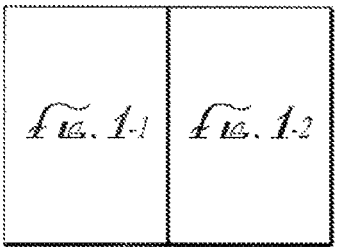
FIG. 1 in FIG. 1-1 and FIG. 1-2 illustrates a schematic diagram showing an embodiment of the invention.
Figure 1:
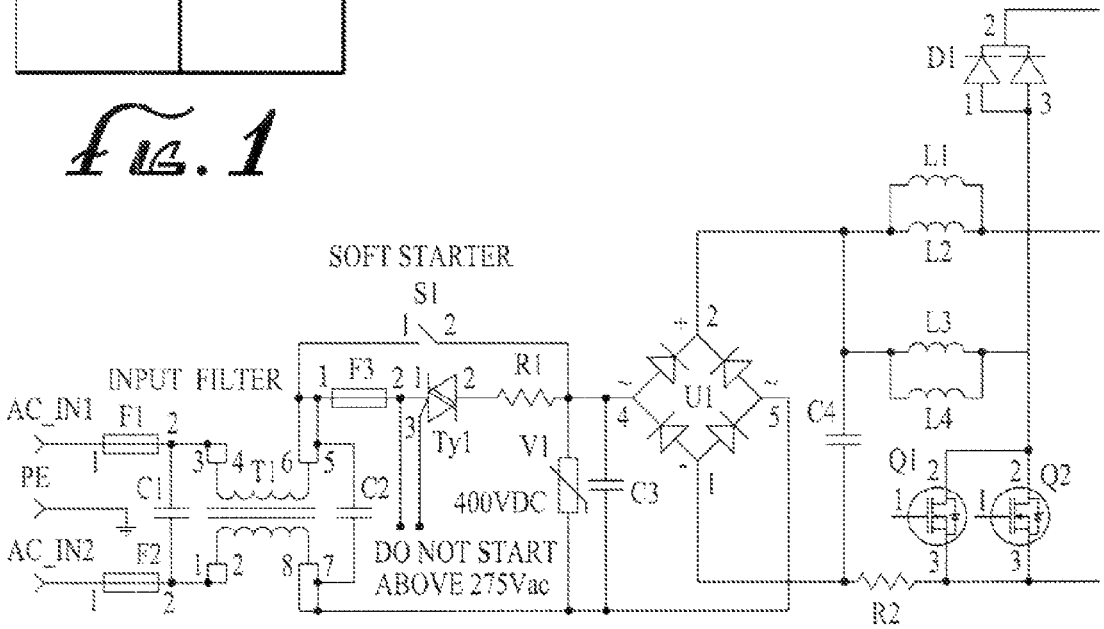
Figure 1:
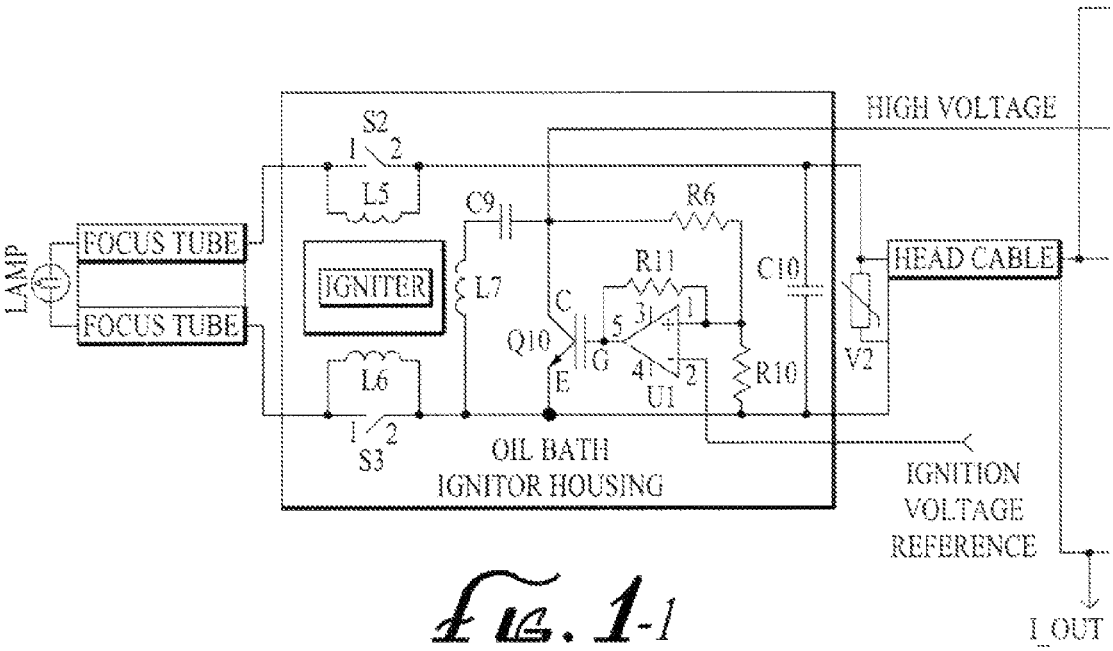
Figures 1, 2:
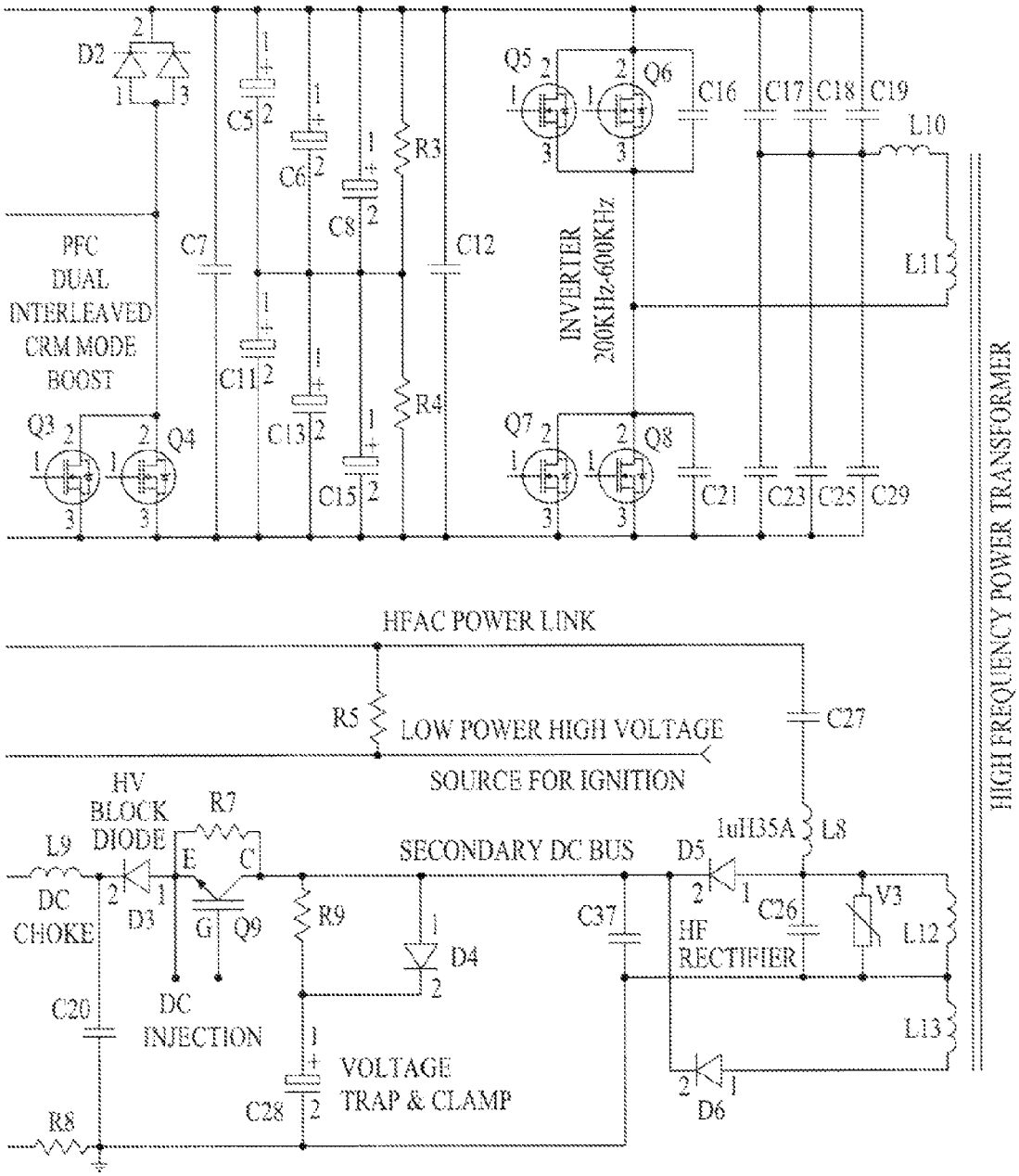
Figure 2:
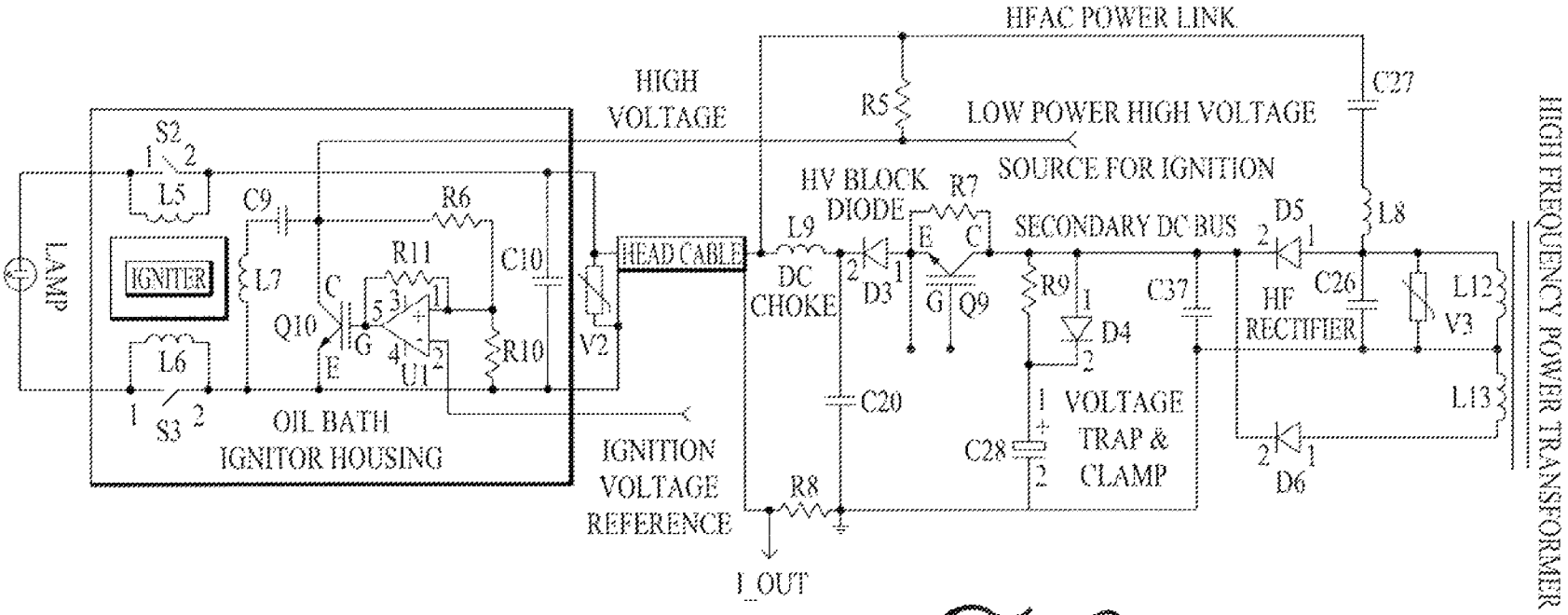
Figure 3:
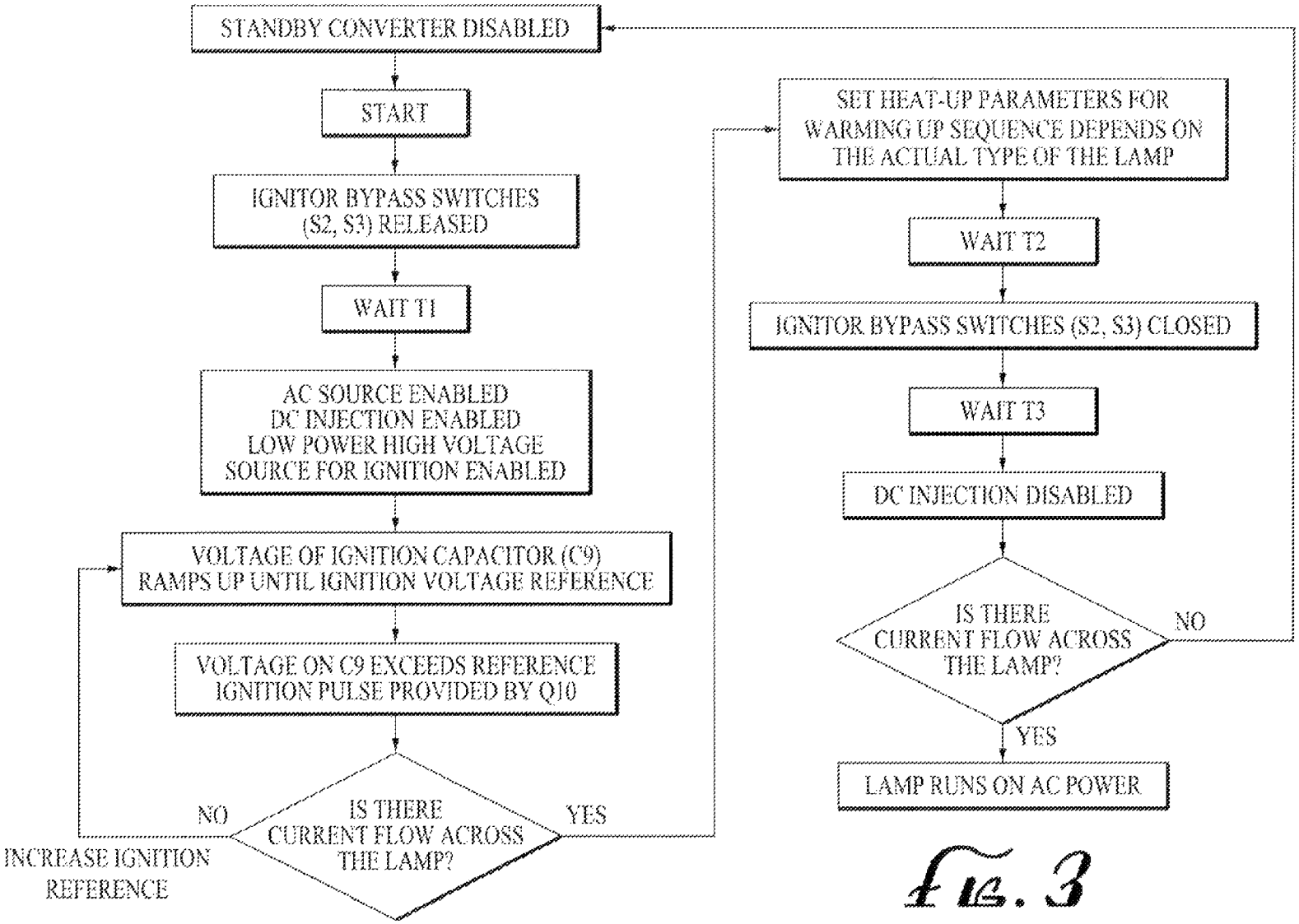
FIG. 3 illustrates a flow chart diagram describing one embodiment in the operation of the high frequency pulse generator of the present invention.

Complex Waveform Operation of High Intensity Discharge Lamp with Optimal Energy Ignition Sequence The power source of the complex waveform generator is based on a two stage high-frequency power converter. Embodiments of the invention are shown and described in FIGS. 1, 2 and 3. Referring to the Figures, the first stage is a boost-type converter realized by Q1, Q2, Q3, Q4 switching devices, D1, D2 diodes and L1, L2, L3, L4 inductors and has a function to provide AC line independent +375V DC on the primary DC bus.

The boost-type converter includes active power factor correction and energy storage to eliminate periodic energy fluctuations caused by the AC line ripple. The high frequency resonant converter is made from Q5, Q6, Q7, Q8 switching devices and drives a power transformer across C17, C29 and L10 serial resonant elements.

The frequency power transformer has the capability of optimal impedance matching to various lamps as well as powering a secondary side rectifier (D5, D6 diodes and C37) for an extra DC power source. The extra DC power source can be turned on/off by the Q9 switch (DC injection). Capacitive coupling of the AC source by the C27 device eliminates DC from the secondary windings of transformer while L9 with C20 has the function of preventing AC energy to no back to the DC source.

In one embodiment of the invention, the complex start-up of the lamp includes the following:

1. The inverter starts to provide AC pulses to the L11 windings which is the primary side of the high-frequency transformer.

2. The pulses appear across the secondary windings L12, L13 and the HF rectifier (D5, D6) starts to charge C37 and C28 capacitors across the D4 diode.

3. DC Injection applied, Q9 receives ON command.

4. Low power high voltage source for ignition enabled and start to charge up C9 in the Igniter.

5. Igniter voltage reference set to a lower value.

6. C27 across R5, C20 and C27 are charging while the secondary DC bus voltage has already reached the nominal maximum value.

7. When C9 voltage reaches the ignition voltage reference (monitored by U1) Q10 turns on and sharply discharges C9 across L7 which is the primary sick of the ignition transformer As soon as C9 discharges high voltage spikes appear on the L5 and L6 windings. The value of high voltage spikes are determined by the turns ratio and actual charge level of C9.

8. The L5, L6 voltage spike is superimposed to the voltage C27. If the voltage of the spike actually is enough to break down the gas in the lamp at first the energy of C10+C27 deposited in the forming are between the electrodes, then the DC injection takes place powering the arc by mainly DC component across Q9, D3, L9 and smaller AC component by L8 and C27.

9. As soon as the arcing is established and lamp current is stable S2, S3 switches bypass the L5, L6 coils so the current flow across L5, L6 is just momentary.

10. Once the switches are closed, the DC injection is turned off by eliminating drive from Q9. From this point, the lamp runs on high-frequency AC current only without DC component.

11. The average power level of the lamp can be modified by varying the density and waveform of driving pulses.

Regarding Step 5, the variable voltage ignition guarantees that the lamp started unit minimal necessary starting energy. If the lamp started always on high energy it would reduce the lamp lifetime by evaporating cold electrodes. The variable ramp has global feedback because the HV spike and C9, C27, C20 voltage are correlated via the R5 path. Therefore, the circuitry of this embodiment not only varies the level of high-voltage ignition but also controls the energy deposited on the cold bulb. Operating parameters of the lamp like lamp current and power can be obtained from a voltage signal on R8 resistor. By changing the frequency and pulse-width of the inverter, the operational parameters of the bulb are controllable.

The operation is maintained always above the characteristic resonant frequency of the serial resonant network formed by L8+L10 and C17, C29 to ensure safe zero-voltage switching conversion for the inverter in all conditions. Moving forward from the serial base frequency lowers the serial resonant current as well as reduces the power on the lamp. This effect can be used to modify the luminous parameters of the high intensity discharge lamp.

Sequential Pulse Ignition

A series of ignition pulses starting from low to high varying both voltage and tune. By varying voltage, for example, starting at 15K, 20K, 30K, 40K, 50K, 60K, 70K all the way up to the physical limits of the igniter in a pre-programmed sequence and repeating the same manner with longer and longer pulses. Embodiments of the invention that have a sequential pulse ignition have the best case scenario for a hot re-strike depending on tamp size and lamp temperature. Embodiments of the invention with sequential pulse ignition enable the use of one igniter for a wide range of lamps. AC/DC ignition assist and silent lamp technology due to high frequency bypassing of current flow through the igniter after ignition.

High Frequency Lamp

Figure 4A:
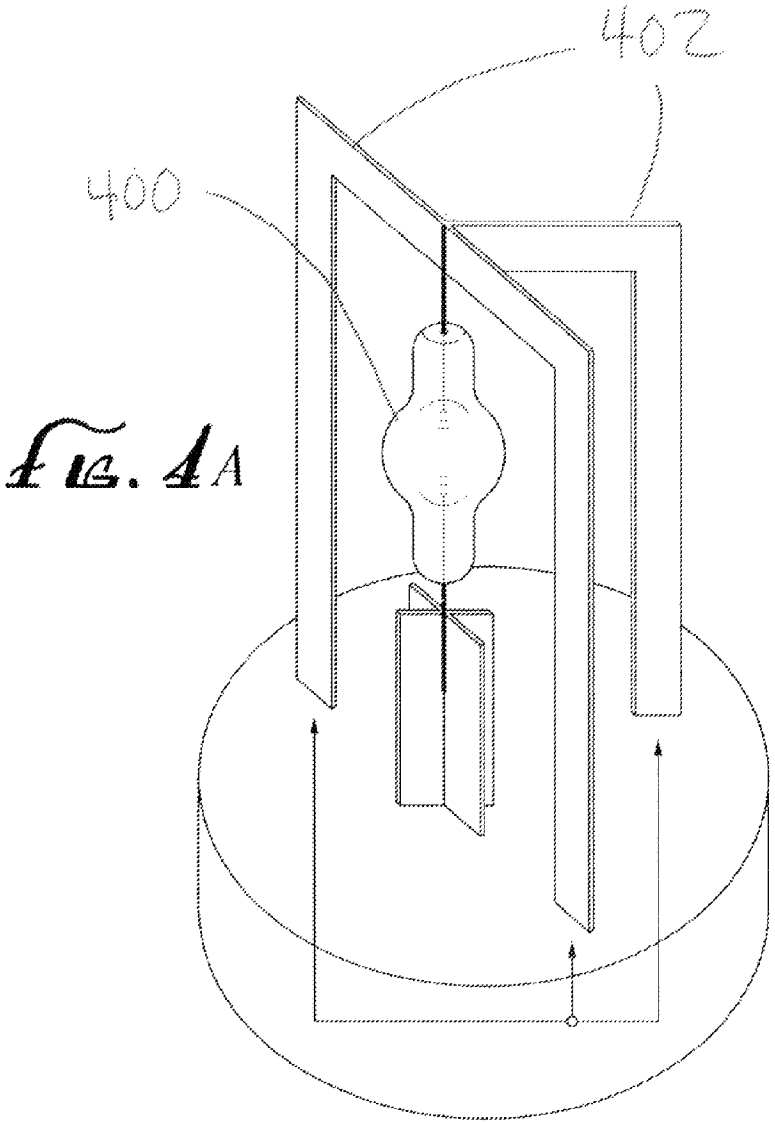
FIG. 4A illustrate an embodiment of the invention showing an internal metal strip frame for a high frequency lamp with FIG. 4B and FIG. 4C illustrating a schematic comparison between the metal strip frame embodiment and conventional connectors.
Figure 4B:
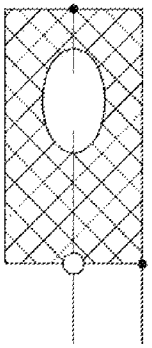
Figure 4C:
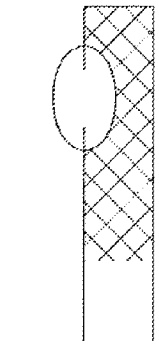

Embodiments of the invention include an internal metal strip frame for a high frequency lamp. FIG. 4 illustrates one embodiment with the light source 400 secured to a frame 402. The frame 402 includes flat metal strips as shown in FIG. 4 of various configurations of metal strip's, including, a tripod configuration shown in FIG. 4, and which are made of nickel, copper or other conductive materials known to skilled persons.

In this high frequency embodiment, there is less inductance and lower loss when compared to conventional connectors due to the skin effect, the tendency for high frequency currents to now on the surface of a conductor, because the frame 402 embodiment has a larger surface area and high frequency flows on the surface.

Figures 5A, 5B, 5C, 5D, 5E:
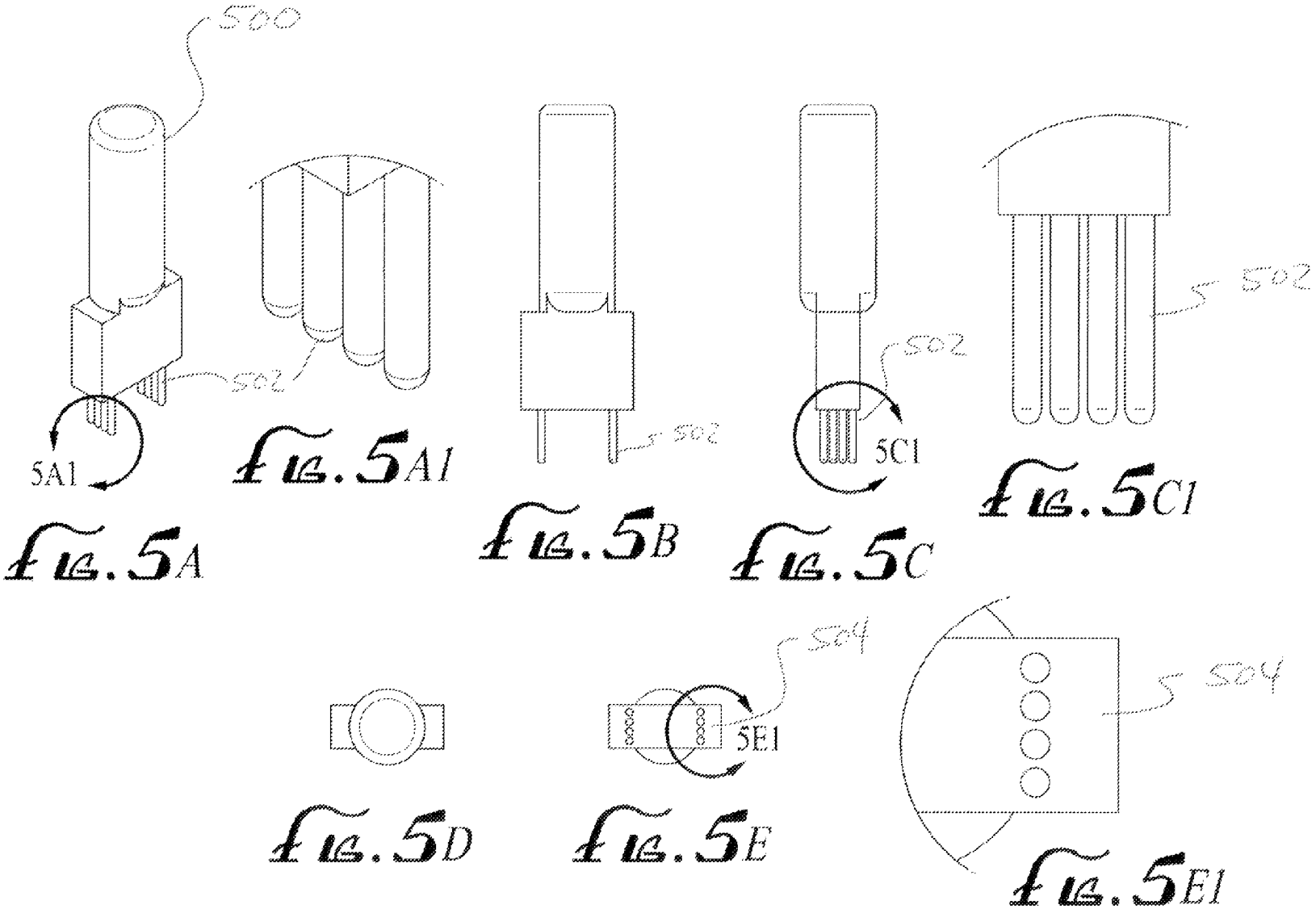

FIG. 5 illustrates a high frequency lamp embodiment with the light source 500 having a series of individual rods 502. The rods 502 may have a substantially circular cross sectional shape. The rods 502 provide a larger surface area to increase current flow to the light source 500 when secured to a conductive surface with similarly shaped openings 504.

Figures 6A, 6B, 6C, 6D, 6E:
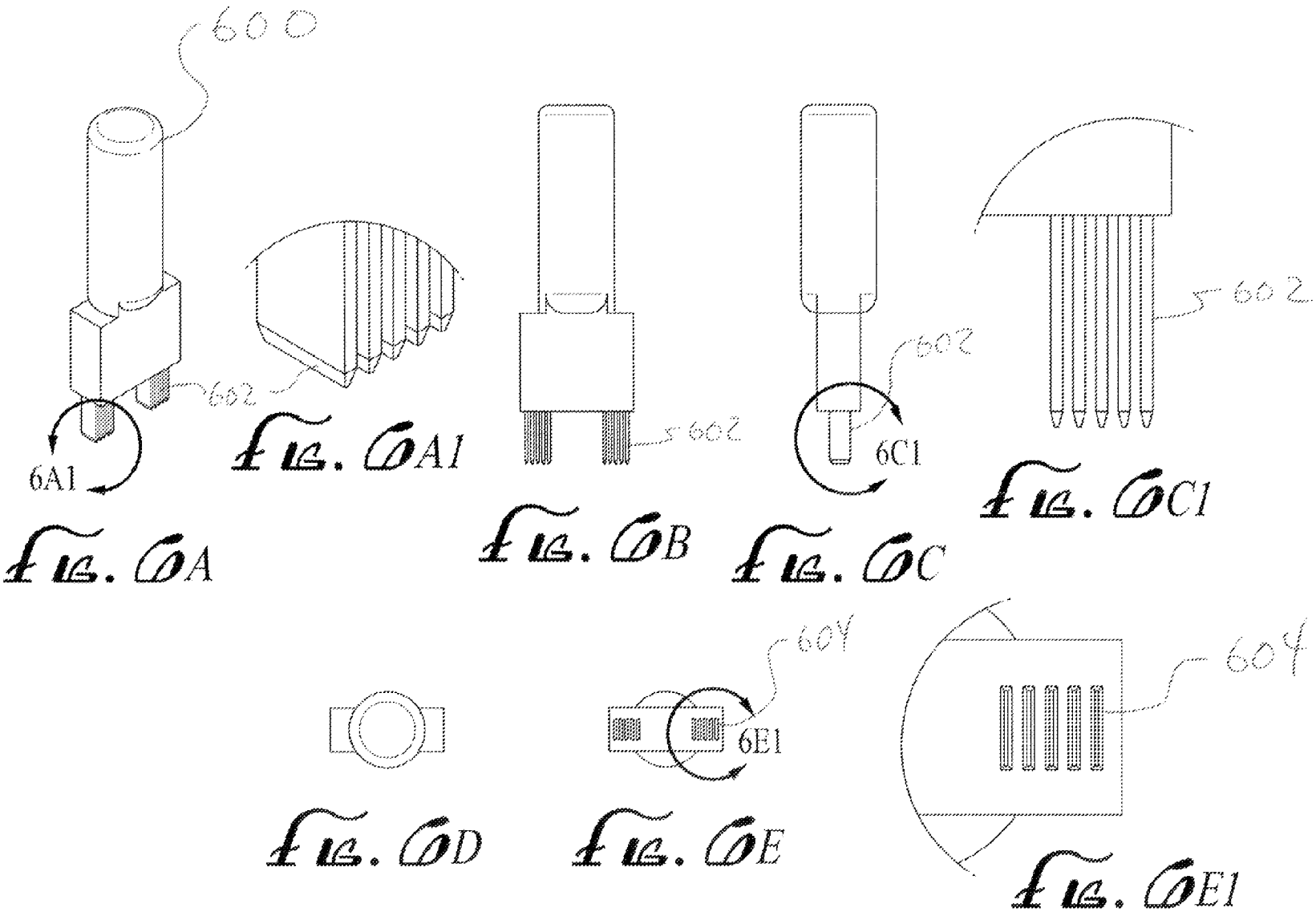

FIG. 6 illustrates an embodiment of a high frequency lamp with the light source 600 that includes a multitude of individual thin plates 602. The plates 602 provide for a large surface area to increase current flow to the light source 600 when secured to a conductive surface with complementary shaped openings 604.

What is claimed is:

1. A high frequency pulse generator having a sequential pulse voltage ignition system coupled to a light source comprising:

an igniter to ignite the light source at substantially the lowest voltage based on the operational characteristics of the light source;

DC injection circuitry operably coupled to the igniter, the DC injection circuitry including a DC source, a diode and inductance, the DC injection circuitry having operational parameters that is configured to be changed to modify the DC waveforms delivered to the igniter and powering the light source based on the operational characteristics of the light source;

AC circuit operably coupled to the light source and operably coupled to an AC source, the AC circuit including igniter bypass switches having an open configuration and a closed configuration so that when the igniter bypass switches are closed AC is provided directly to the light source to bypass the igniter and the light source is supplied with AC only; and control circuitry operably connected to the DC injection circuitry and to the AC circuit to control operation of the DC injection circuitry and the AC circuit so that alternatively DC alone, DC with superimposed AC, or AC alone is provided to the light source based on the operational characteristics of the light source.

2. The high frequency pulse generator of claim 1 including a transformer having primary windings and secondary windings, wherein capacitive coupling of the AC source by a capacitor (C27) is configured to substantially eliminate DC from the secondary windings of the transformer and including an inductor (L9) and a second capacitor (C20) configured to substantially prevent AC to reach the DC source of the DC injection circuitry.

3. The high frequency pulse generator of claim 1 wherein the color temperature of the light source is substantially controlled by user selected current and voltage characteristics input to the light source that are selected based on the operational characteristics of the light source.

4. The high frequency pulse generator of claim 1 further comprising a high frequency lamp wherein the light source is secured to an electrically conductive frame of metal strips.

5. The high frequency pulse generator of claim 1 wherein the light source includes a plurality of electrically conductive rods adapted to be secured to a complementary shaped conductive surface.

6. The high frequency pulse generator of claim 1 with the light source operatively connected to electrically conductive flat plates adapted to be secured to a complementary shaped conductive surface.

7. A method for igniting and operating a high pressure gas discharge lamp with a high frequency pulse generator having an igniter coupled to the lamp, DC injection circuitry operably coupled to the igniter, and an AC circuit operably coupled to the lamp and an AC source, the AC circuit including igniter bypass switches having an open configuration and a closed configuration so that when the igniter bypass switches are closed AC is provided to the lamp to bypass the igniter so that the lamp is provide with AC only, comprising the steps of:

opening the igniter bypass switches;

enabling the AC source;

enabling the DC injection circuitry to provide a low power high voltage DC for the igniter so that the voltage of an ignition capacitor ramps up to a reference ignition voltage based on the operational characteristics of the lamp until the voltage on the ignition capacitor exceeds the reference ignition voltage;

enabling the high current DC injection circuitry with an adjustable reference current superimposed on the high voltage DC for the igniter and on the AC source;

setting the parameters for the warming up sequence for the lamp based on the operational characteristics of the lamp once there is current flow across the lamp;

setting the parameters for the warming up sequence for the lamp based on the operational characteristics of the lamp once there is current flow across the lamp;

closing the igniter bypass switches; and disabling the DC injection circuitry so that the lamp runs on AC power alone.

8. A high frequency pulse generator having a sequential pulse voltage ignition system adapted to be coupled to a high pressure gas discharge lamp comprising:

an inverter to provide AC pulses to inductive windings (L11) of the primary side of a high-frequency transformer;

a high-frequency rectifier (D5, D6) operably coupled to secondary inductive windings (L12, L13) so as to charge capacitors (C37, C28) across a diode (D4);

DC injection circuitry having a switching device (Q9) to provide DC to an igniter capacitor (C9) upon receipt of an ON command to charge up the igniter capacitor (C9), wherein:

a reference voltage for the igniter voltage is set to a predetermined value, capacitor (C27), capacitor (C20) and capacitor (C27) are charged while a secondary DC bus voltage has already reached a nominal maximum value so that when igniter capacitor (C9) voltage reaches the ignition voltage reference, switch (Q10) turns on and discharges igniter capacitor (C9) across inductor (L7) which is the primary side of an ignition transformer and igniter capacitor (C9) discharges, high voltage spikes appear on inductor (L5) and on inductor (L6) and the value of high voltage spikes are determined by the turns ratio of the inductor (L5) and the inductor (L6) and by the actual charge level of igniter capacitor (C9), and the inductor (L5) and the inductor (L6) voltage spike is superimposed to the voltage on capacitor (C27) and if the voltage of the spike actually is enough to break down the gas in the lamp at first, the energy of capacitor (C10) and capacitor (C27) is deposited on a forming arc between electrodes of the lamp, and resistor (R9) limits a peak current of discharge from capacitor (C28) to an acceptable level of the lamp to establish a safe arc, then the DC injection circuitry begins to provide DC to power the arc of the lamp by mainly a DC component across switch (Q9), diode (D3), inductor (L9) and a smaller AC component by inductor (L8) and capacitor (C27), and the characteristic impedance of the serial resonant network composed of capacitor (C27) and inductor (L8) limits the reflected energy transferred to the high-frequency transformer; and an AC circuit adapted to be operably coupled to the lamp and operably coupled to an AC source, the AC circuit including igniter bypass switches (S1, S2) so that the arc in the lamp is established and lamp current is stable, the igniter bypass switches (S1, S2) are closed to bypass the inductor (L5) and the inductor (L6) and then the DC source from the DC injection circuit is turned off so that the lamp runs on AC only without a DC component.

9. The apparatus of claim 8 wherein capacitive coupling of the AC source by a capacitor (C27) is adapted to substantially eliminate DC from the secondary inductive windings (L12, L13) of the transformer and including an inductor (L9) and a second capacitor (C20) configured to substantially prevent AC to reach the DC source of the DC injection circuitry.

10. The apparatus of claim 8 wherein the average power level of the lamp can be modified by varying the density and waveform of driving pulses delivered to the lamp.

11. The apparatus of claim 8 wherein by changing the frequency and pulse-width output of the inverter, the operational parameters of the lamp are controllable.

12. The apparatus of claim 8 wherein the lamp is ignited with the lowest starting energy based on the operational characteristics of the lamp.

13. The apparatus of claim 8 wherein the lamp operating parameters lamp current and power of the lamp are obtained from a voltage signal on a resistor (R8).

14. The apparatus of claim 8 wherein the high voltage spikes that appear on inductor (L5) and on inductor (L6) and the voltage on capacitor (C9), the voltage on capacitor (C27) and the voltage on capacitor (C20) are correlated via a resistor (R5).

* * * * *